US007910231B2

(12) United States Patent
Schuh et al.

(10) Patent No.: US 7,910,231 B2
(45) Date of Patent: Mar. 22, 2011

(54) PREPARATION AND PROPERTIES OF CR-C-P HARD COATINGS ANNEALED AT HIGH TEMPERATURE FOR HIGH TEMPERATURE APPLICATIONS

(75) Inventors: Christopher A. Schuh, Ashland, MA (US); Marcelo J. L. Gines, San Nicolas (AR)

(73) Assignee: Massachusetts Institute of Technology, Cambridge, MA (US)

( * ) Notice: Subject to any disclaimer, the term of this patent is extended or adjusted under 35 U.S.C. 154(b) by 607 days.

(21) Appl. No.: 11/977,147

(22) Filed: Oct. 23, 2007

(65) Prior Publication Data

US 2008/0166531 A1 Jul. 10, 2008

Related U.S. Application Data

(60) Provisional application No. 60/858,217, filed on Nov. 9, 2006.

(51) Int. Cl.
*B32B 9/00* (2006.01)

(52) U.S. Cl. ..... 428/704; 428/698

(58) Field of Classification Search ..... None
See application file for complete search history.

(56) References Cited

U.S. PATENT DOCUMENTS

| | | | |
|---|---|---|---|
| 5,190,796 | A | 3/1993 | Iacovangelo |
| 6,649,682 | B1 | 11/2003 | Breton et al. |
| 6,767,653 | B2 | 7/2004 | Bewlay et al. |
| 7,075,704 | B2 | 7/2006 | Kurashina |

OTHER PUBLICATIONS

International Preliminary Report on Patentability mailed May 22, 2009, PCT/US2007/000146.

International Search Report, PCT/US07/00146.

Baral, A., and Engelken, R., "Modeling, Optimization, and Comparative Analysis of Trivalent Chromium Electrodeposition from Aqueous Glycine and Formic Acid Baths", Journal of the Electrochemical Society, 152(7) (2005), C504-C512.

Benaben, P., "Composite Nanomaterials: Contribution of Chromium Electrodeposition", AEST SUR/FIN 2005, Saint Louis, MI, USA, 2005, pp. 43-58.

Deneve, B.A. and Lalvani, S.B., "Electrodeposition and characterization of amorphous Cr-P alloys", Journal of Applied Electrochemistry, 22 (1992), 341-346.

Hwang, Jin-Yih, "Trivalent Chromium Electroplating for Baths Containing Hypophosphite Ions", Plating and Surface Finishing, 78(5) (1991), 118-125.

Kim, M., Park, S.U., Kim, D.Y., Kwon, S.C., and Choi, Y., "Characterization of Chromium-Carbon Layer Fabricated by Electrodeposition in Trivalent Chromium Bath", Materials Science Forum, 475-479 (2005), 3823-3826.

(Continued)

*Primary Examiner* — Timothy Speer
(74) *Attorney, Agent, or Firm* — Steven J. Weissburg

(57) ABSTRACT

Chromium plating from the trivalent state is relatively environmentally friendly as compared to a hexavalent chromium bath. Incorporation of non-metallic and metalloid elements into the coating should lead to enhanced properties. The relationship between composition, structure, and properties of annealed Cr—C—P layers electrodeposited from chromium-based trivalent baths is discussed. These coatings are amorphous in the as-deposited state, but upon thermal treatments, chromium nanocrystallization, as well as precipitation of carbides and phosphides occurs. Incorporation of phosphorous strongly influences the structural evolution and mechanical properties. Electroplated Cr—C alloy coatings exhibit significant increases in hardness and strength, when exposed to temperatures up to about 600° C., owing to the evolution of their nanostructure. This evolution can be shifted to higher temperatures (approaching 850° C.), through a ternary addition of phosphorous. The resulting Cr—C—P coatings may be suitable for applications at higher service temperatures, where more conventional Cr-based coatings soften rapidly.

10 Claims, 13 Drawing Sheets

OTHER PUBLICATIONS

Kwon, S.C., Kim, M., Park, S.U., Kim, D.Y., Kim, D., Nam, K.S., and Choi, Y., "Characterization of intermediate Cr-C layer fabricated by electrodeposition in hexavalent and trivalent chromium baths", Surface and Coatings Technology, 183 (2004), 151-156.
Tu, Z., Yang, Z, and Zhang, J., "Pulse Plating with a Trivalent Chromium Plating Bath", Plating and Surface Finishing, 77(10) (1990), 55-57.
Gines, M.J.L., Williams, F.J., and Schuh, C.A., "Strategy to Improve the High-Temperature Mechanical Properties of Cr-Alloy Coatings", Metallurgical and Materials Transactions A, 38A (2007), 1367-1370.
Gines, M.J.L., Williams, F.J., and Schuh, C.A., "Nanostructured Cr-C Coatings for Application at High Temperatures", Journal of Applied Surface Finishing, 2(2) (2007), 112-121.
Gines, M.J.L., Williams, F.J., and Schuh, C.A., "Nanostructure Properties of Cr-C Coatings", 2006 SUR/FIN Proceedings, 121-131.

PREPARATION AND PROPERTIES OF CR-C-P HARD COATINGS ANNEALED AT HIGH TEMPERATURE FOR HIGH TEMPERATURE APPLICATIONS

RELATED DOCUMENTS

The benefit of U.S. Provisional application No. 60/858,217, filed on Nov. 9, 2006, is hereby claimed, and it is fully incorporated herein by reference.

BACKGROUND

Figure 1A:
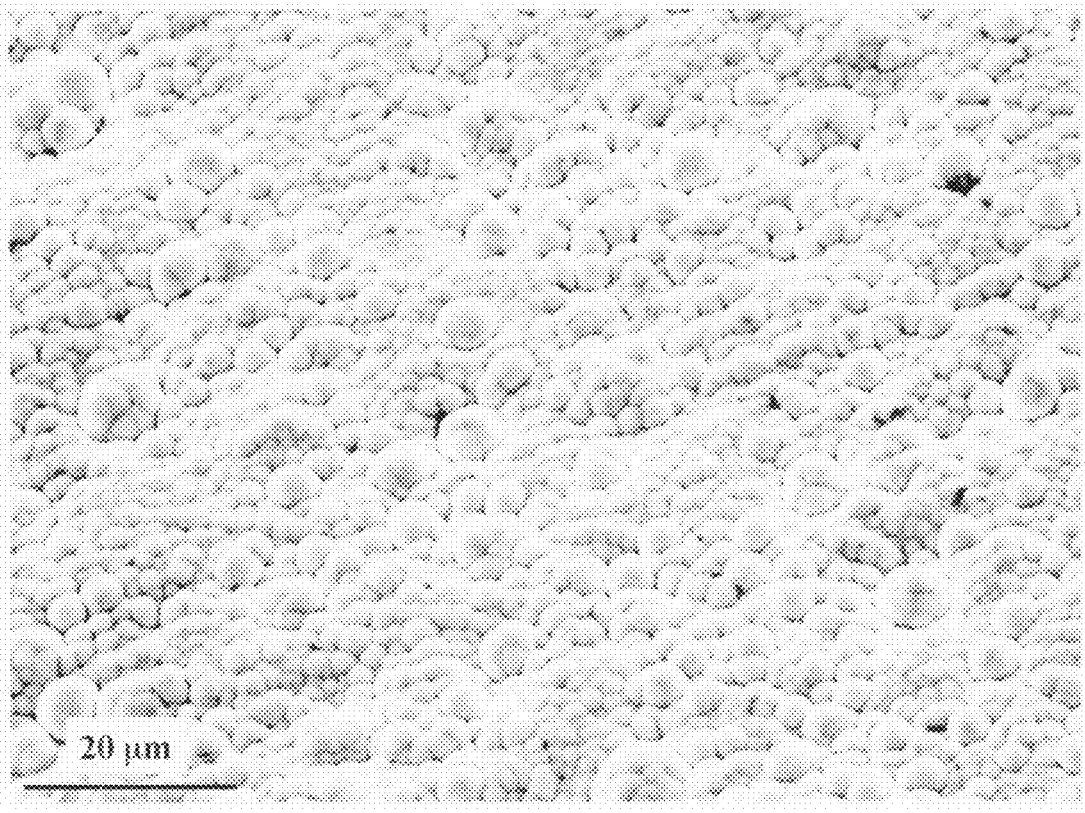
FIG. 1A is an SEM digital image of an as-deposited Cr—P coating (20.3 wt. % P), in plan view, magnification 1000×.

Electrodeposited chromium coatings are extensively employed across many industries, and can be plated from either hexavalent or trivalent baths. For many years the hexavalent bath has been used to produce so called hard chromium coatings, with good wear and corrosion resistance; however, these are quite temperature sensitive, and their contact and wear properties decline rapidly at elevated service temperatures. Further, chemical baths based on hexavalent chromium, which are highly toxic and oxidative, have detrimental effects on the environment and on the health of those working with them. In contrast, chromium plated from the trivalent state frequently contains metalloid alloying elements like C, which fundamentally change the evolution of the coating microstructure upon heating; unlike hard chromium coatings, such alloy deposits harden considerably upon heating. Cr—C coatings derived from a trivalent bath may have broad applications in elevated-temperature environments. As an added benefit, the health and environmental concerns about trivalent baths are dramatically lower than for hexavalent ones.

Despite the advantages of Cr—C alloy deposits, the range of temperatures for which these coatings are suitable remains limited (<600° C.). This range is useful for some machine or engine applications, but is insufficient for, e.g., hot metalwork tooling surfaces. For this reason, it is desirable to develop new coatings with desirable hardness and surface properties even after heating to ~800 or 900° C.

BRIEF SUMMARY

The inventions disclosed herein introduce a strategy to improve upon Cr—C derived from a trivalent bath, through the addition of P to the coating. And while addition of phosphorous to such coatings has been discussed from an electrochemical point of view in prior literature, the ability of P additions to promote strengthening of such coatings after high-temperature exposure has not been known before. By properly tuning the deposition bath chemistry, the temperature at which maximum hardness is achieved can be intentionally manipulated.

Electrolytic trivalent chromium baths contain either an organic additive or sodium hypophosphite in order to prevent the hydrolysis of chromium ions, which need a high potential to be reduced to metallic chromium in the range where the competitive reaction of hydrogen evolution prevails. Phosphorus is incorporated into the coating when hypophosphite-based baths are employed, but may also be introduced by addition of hypophosphite in organic baths, or by electroless deposition.

It is known that the addition of phosphorus to a chromium-based coatings leads to better corrosion properties and forms an amorphous structure, but few studies have examined the mechanical properties in the as-deposited state, and the high temperature performance or that induced by additional heat treatments have not been studied. Knowledge of the relationship among composition, thermal processing conditions, and phase transformation behavior is fundamental to the design of enhanced materials. The effect of annealing on structure and mechanical properties of Cr—P and Cr—C—P coatings obtained by electrodeposition from trivalent-based chromium baths is examined in detail below.

A preferred embodiment of an invention hereof is a coated article comprising: a substrate; and a coating on the substrate, comprising: chromium, carbon and phosphorous, the chromium and the phosphorous being present in at least one of the compounds selected from the group consisting of: CrP; and $Cr_3P$. Typically, chromium of the coating comprises the body-centered cubic chromium phase.

The coating may have individual phase domains having a mean characteristic size of smaller than approximately 500 nanometers.

In an advantageous embodiment, the coating has a hardness greater than 900 kgf/mm$^2$. The coating may similarly have a hardness of greater than 500 kgf/mm$^2$ at a temperature greater than 100° C. and even at a temperature greater than 600° C. With some embodiments, the coating may have a hardness of greater than 1000 kgf/mm$^2$ at a temperature greater than 650° C. and even at a temperature greater than 800° C.

In a general characterization of an important embodiment, the coating may have a hardness that is higher than that of an otherwise substantially identical phosphorous-free coating that has experienced a substantially identical thermal history.

According to an important embodiment, the coating is an electrolytically deposited coating.

With a related important embodiment, the coating is a vapor deposition coating.

For still another preferred embodiment, an invention hereof is a process for coating a substrate, comprising the steps of: providing a substrate; depositing on the substrate the elements chromium, carbon and phosphorous; and exposing the substrate and deposited elements to a sufficient temperature for a sufficient time to produce a coating comprising at least one of the compounds selected from the group consisting of: CrP; and $Cr_3P$.

With a related method embodiment, the step of coating is an electrolytic deposition. Or, it may be by vapor deposition, such as sputtering.

An important embodiment of a method invention hereof is that the step of exposing comprises exposing the substrate and deposited elements to a sufficient temperature for a sufficient time to produce a coating comprising body centered cubic chromium.

Still another related embodiment includes as the step of exposing, exposing the substrate to an annealing temperature for at least five minutes, and even for at least 30 minutes. The annealing temperature may be greater than 650° C. Annealing may be passive. Or, it can be through service at an elevated temperature, which temperature need not be as high as a temperature at which passive annealing takes place.

With yet another preferred embodiment the step of exposing comprises exposing the substrate and deposited elements to a sufficient temperature for a sufficient time to produce individual phase domains having a mean characteristic size of less than about 500 nanometers.

Embodiments are contemplated where the step of exposing comprises exposing the substrate and deposited elements to a sufficient temperature for a sufficient time to produce a coating having a hardness greater than 900 kgf/mm$^2$.

And, another useful embodiment discloses exposing the substrate and deposited elements to a sufficient temperature for a sufficient time to produce a coating having a hardness of greater than 500 kgf/mm$^2$ at a temperature greater than 100° C. and yet another, at a temperature greater than 600° C. With some preferred embodiments, the step of exposing comprises exposing the substrate and deposited elements to a sufficient temperature for a sufficient time to produce a coating having a hardness of greater than 1000 kgf/mm$^2$ at a temperature greater than 650° C.

In a general expression of an embodiment of a method invention hereof, the step of exposing comprises exposing the substrate and deposited elements to a sufficient temperature for a sufficient time to produce a coating having a hardness that is higher than that of an otherwise identical but phosphorous free coating, that has experienced a substantially identical thermal history.

EXPERIMENTS

The electrolytic baths employed are based on trivalent chromium. One of them has organic complexing agents and the other contains sodium hypophosphite as the primary complexing agent. A detailed composition of each electrolytic bath is listed in Table 1.

TABLE 1

Composition and role of chemicals present in the plating baths used in this study for Cr—P and Cr—C—P.

| Constituent | Concentration [g/L] | Function |
|---|---|---|
| Bath A | | |
| $CrCl_3 \cdot 6H_2O$ | 110 | Source of $Cr^{3+}$ |
| $NH_4Cl$ | 180 | Electrolyte support and complexing agent |
| $NaH_2PO_2 \cdot H_2O$ | 240 | Source of P and complexing agent |
| NaF | 4 | Antioxidizing agent |
| $H_3BO_3$ | 15 | Buffer agent |
| Dodecyl $NaSO_4$ | 0.2 | Wetting agent |
| Bath B | | |
| $CrCl_3 \cdot 6H_2O$ | 110 | Source of $Cr^{3+}$ |
| $NH_4Cl$ | 80 | Electrolyte support and complexing agent |
| $HCOO(NH_4)$ | 40 | Organic complexing agent |
| $NaCH_3COO$ | 15 | Organic complexing agent |
| $NH_4Br$ | 10 | Antioxidizing agent |
| $H_3BO_3$ | 45 | Buffer agent |
| KCl | 40 | Electrolyte support |
| Dodecyl $NaSO_4$ | 0.2 | Wetting agent |
| $NaH_2PO_2 \cdot H_2O$ | 0-20 | Source of P |

Baths were prepared using reagent grade chemicals and deionized water. In order to reach a quasi-equilibrium state with $Cr^{3+}$ organic complexes, baths containing organic agents were heated to 90° C. for 20 min, and subsequently stirred for 24 h before use. The pH of the solution was adjusted by adding HCl or NaOH prior to each plating experiment.

All plating experiments were carried out using a custom cylindrical cathode of either copper or steel, which was rotated at 400 rpm during deposition to promote an even current density distribution and a controlled turbulent flow. Platinum mesh was used as the anode, and direct or pulsed current was supplied by a Dynatronix DPR20-30-200 power supply (generally 30 A/cm$^2$, with on-time of 5 ms and off-time of 5 ms). The typical cathodic cycle pulse consisted of peak current density ($J_p$) in the range of 5-40 A/dm$^2$, and on-($T_{on}$) and off-time ($T_{off}$) ranged from 5 to 40 ms. Just before plating, the cathode was degreased with acetone, mechanically polished to a mirror-like surface (1 mm), thoroughly rinsed with deionized water and dried with clean compressed air. All the plating experiments were conducted at room temperature (20-25° C.). As-deposited samples were annealed in Ar for 30 min at a prescribed temperature, with a heating rate of ~40-50 K/min, and furnace cooling under an argon flow.

The surface morphology as well as metallographically prepared cross sections of each sample were characterized by scanning electron microscopy (SEM) using LEO 438VP equipment. Chemical composition was assessed using energy dispersive spectroscopy (EDS) as well as electron spectroscopy for chemical analysis (ESCA). X-ray diffraction (XRD) was employed to evaluate the phases in the coatings, to determine the structure of the electrodeposits as well as to estimate the average crystallite size from Cr (110) line-broadening using the Scherrer equation. A Rigaku RU300 diffractometer with Cu—$K_\alpha$ radiation was used.

Micro-hardness tests were conducted on polished cross sections of the electrodeposits using a Vickers indenter with 10 g load and using a Clark micro-indenter model DMH2. Ten measurements were made for each load, and the average is reported. For a 10 g load the ratio between the mean indentation diagonal and coating thickness is close to 10 for all samples. To examine the effect of thermal exposure on the structure and properties of the coatings, annealing treatments were carried out in argon at various temperatures up to 900° C., with a constant time-at-temperature of 30 minutes.

DISCUSSION

Figure 1B:
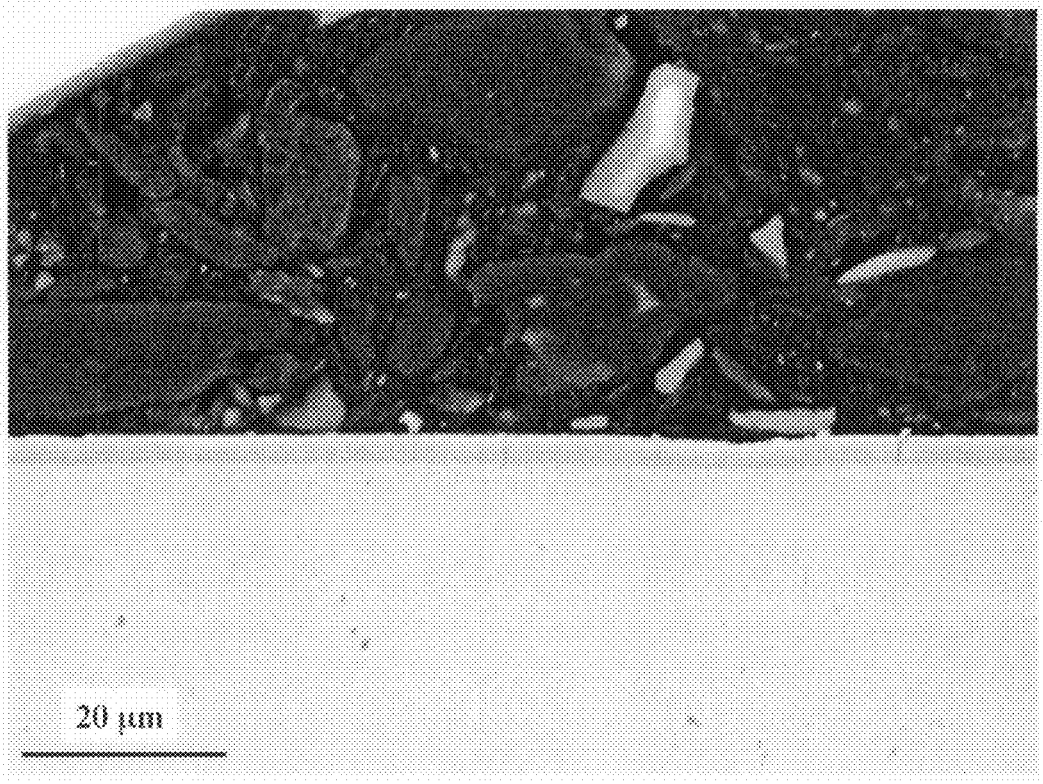
FIG. 1B is a schematic representation of a cross-sectional view, magnification 1000× of the Cr—P coating shown in FIG. 1A.
Figure 2:
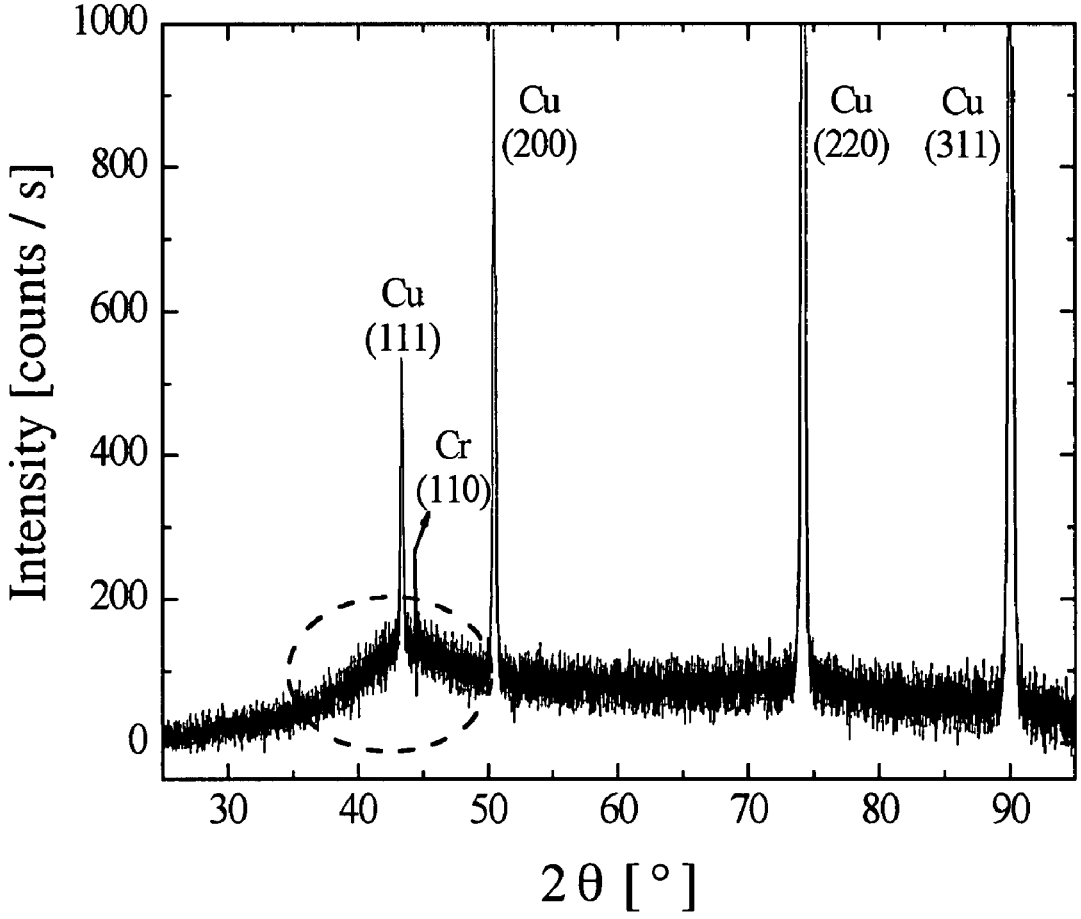
FIG. 2 shows a typical XRD pattern of an as-deposited Cr—C—P coating (20.3 wt. % P).

The morphology of the coatings obtained with the hypophosphite-based bath (Bath A) was observed on both cross-sectional and plan views by scanning electron microscopy. FIG. 1A shows a plan view and FIG. 1B a cross-sectional view of a typical coating. All deposits looked the same regardless of the electrochemical parameters employed, displaying a nodular morphology with very few and small cracks. The thickness was homogeneous but always quite thin ranging from 0.5 to 5 mm. A typical XRD spectrum from an as-deposited coating is shown in FIG. 2. The very broad peak in the vicinity of the Cr (110) reflection suggests that the coatings are amorphous. Copper peaks are due to reflections from the copper substrate, visible because of the low thickness (3 mm). Similar results were reported by Hwang. It is well known that the addition of a metalloid, like phosphorus or carbon, to form a metallic alloy (Cr—C, Cr—P, Ni—P, Fe—P) may lead to an amorphous structure, depending on the metalloid concentration in the alloy and the method of preparation. For instance, Lalvani et al. employing x-ray absorption spectroscopic analysis (EXAFS) reported that a Cr—P alloy obtained by electrodeposition was amorphous.

The EDS analysis shows that significant amounts of phosphorus were incorporated into the chromium-based coatings, ranging from 14.5 to 42.0 wt. % depending on the wave form employed for electrodeposition.

TABLE 2

Electrodeposition parameters, thickness, and phosphorus concentration in the Cr—P coatings prepared using Bath A.

| Charge [C/dm$^2$] | $J_m$[a] [A/dm$^2$] | $T_{on}$ [ms] | $T_{off}$ [ms] | q[b] [%] | Thickness [mm] | P content[c] [wt. %] |
|---|---|---|---|---|---|---|
| 108000 | 30 | 2.5 | 7.5 | 25 | <0.5 | 42.0 ± 1.4 |
| 108000 | 30 | 5.0 | 5.0 | 50 | 2.6 | 20.3 ± 0.3 |
| 108000 | 30 | — | — | 100 (DC)[d] | 4.2 | 14.5 ± 0.3 |
| 54000 | 30 | 5.0 | 5.0 | 50 | 2.2 | 19.1 ± 0.2 |
| 54000 | 20 | 5.0 | 5.0 | 50 | 2.0 | 19.3 ± 0.2 |
| 216000 | 20 | 5.0 | 5.0 | 50 | 4.0 | 21.5 ± 0.6 |

$J_m$: Average current density;
[b]q: Duty cycle [100 * $T_{on}/(T_{on} + T_{off})$];
[c]Determined by EDS;
[d]DC: Direct current As the duty cycle (q) increases, the phosphorus content decreases. These results agree with those published by Song et al. It was also found that as transferred charge increases, the efficiency decreases (Table 2) for coatings with a phosphorus content close to 20 wt. %. Similar results were reported by Vinokurov et al. using a hypophosphite-based trivalent chromium bath with the addition of carbamide. Phosphorus, as a metalloid, has a much higher electrical resistance ($1\times10^{15}$ mW-m) than metallic chromium (0.129 mW-m).

Figure 3:
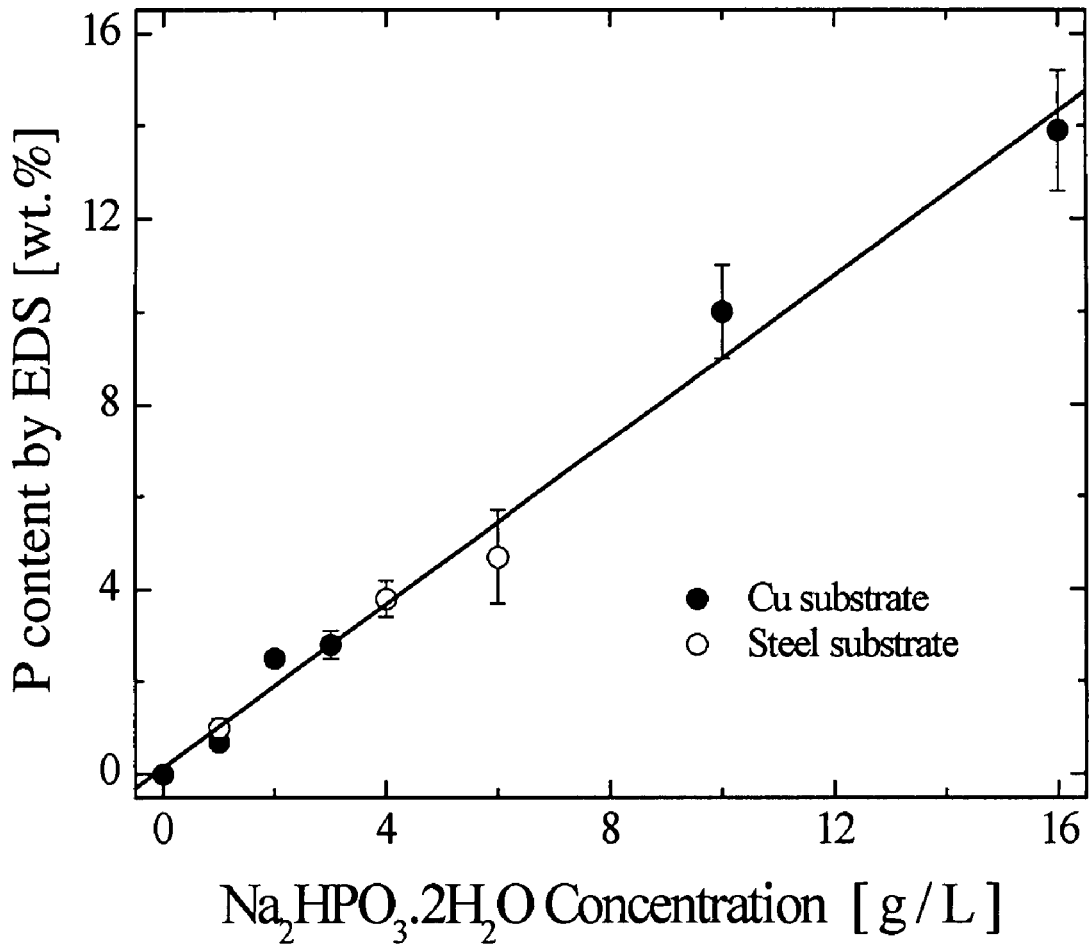
FIG. 3 shows, graphically, the phosphorus content in Cr—C—P coatings as a function of phosphorus in the electrolytic bath (Table 1), where peak current density=30 A/dm$^2$; $t_{on}$=$t_{off}$=5 ms; Total charge transferred=72000 C/dm$^2$; Temperature=20-25° C.

By an alternative method, Deneve et al. have obtained chromium-based coatings with higher thicknesses and lower phosphorus contents by using an organic-based trivalent chromium bath. Consequently, several coatings were prepared from an organic-based trivalent chromium bath, with sodium hypophosphite as the source of phosphorus (Table 1). The effect of bath composition was studied by changing the concentration of hypophosphite in the bath, ranging from 0 to 16 g/L, while the others constituents remained constant. EDS spectra acquired on the cross sectional view (not shown here) revealed the presence of carbon, oxygen, phosphorus, and chromium. In FIG. 3, a direct linear relationship between the concentration of hypophosphite in the bath and the phosphorus content of the coatings is clearly observed. In this way, it was possible to obtain phosphorus contents as low as 1 wt. % and thicknesses higher than 45 mm with reasonable values of transferred charge (108000 C/dm$^2$).

Figure 4:
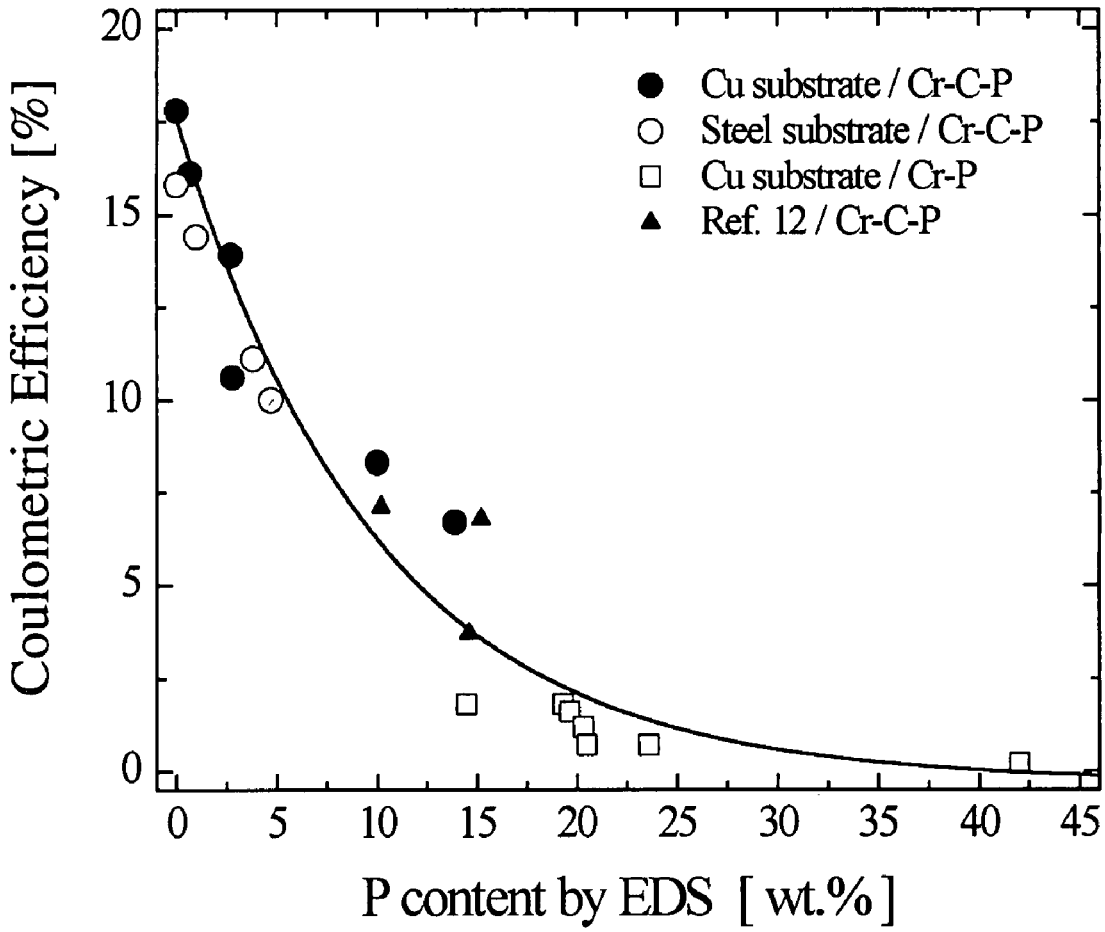
FIG. 4 shows, graphically, the coulometric efficiency as a function of phosphorus content in Cr—P and Cr—C—P coatings using baths A and B, respectively (Table 1).

All the coulometric efficiencies from baths A and B were plotted against the phosphorus content determined by EDS (FIG. 4). The incorporation of phosphorus into the coating apparently leads to a decreased efficiency of electrodeposition. This can be attributed to the increase of the electrical resistivity of the coating with phosphorus content. In pure nickel the specific electrical resistivity is 0.073 mW-m, which becomes 0.6-1.42 mW-m in deposits containing 4.6-14 wt. % P. Fukamichi et al. showed that the electrical resistivity of Fe—P amorphous ribbons prepared by melt quenching increases, as phosphorus content increases and has higher values than Fe—B amorphous alloys. Ivanov reported that the resistivities of electroless Ni—P and Ni—P—B deposits become much higher than Ni as phosphorus concentration rises. Furthermore, Keong et al. mentioned that for Ni—P electroless coatings in the as-deposited state, the electrical resistivity increases with increasing phosphorus content. On the other hand, Seo et al. have found that current efficiencies decreased with increasing bath concentration of $H_3PO_3$ when Ni—P coatings were prepared by electrodeposition. Based on similar results, they reported that it can be expected that $H_3PO_3$ concentration in the baths affected hydrogen overvoltage by changing of the Ni—P alloy composition in the deposit during electrodeposition.

Figure 5A:
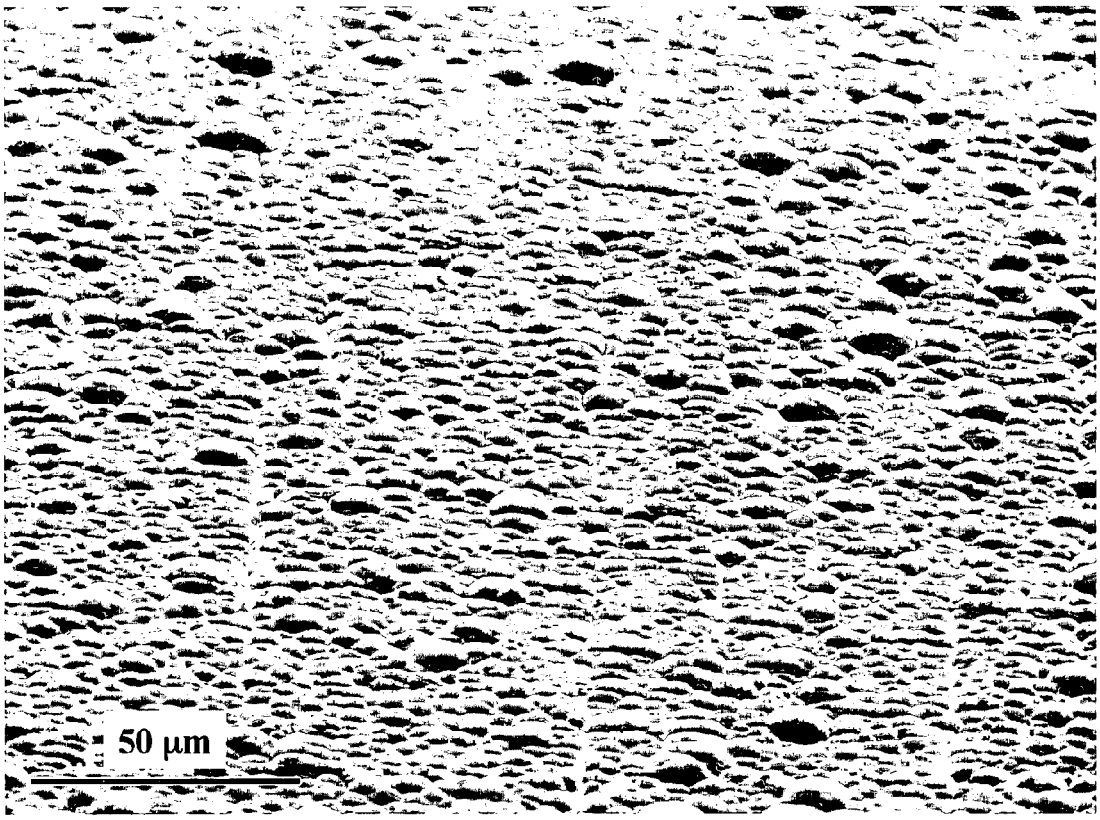
FIG. 5A is an SEM digital microimage of an as-deposited Cr—C—P coating (2.8 wt. % P) in plan view, magnification 500×.
Figure 5B:
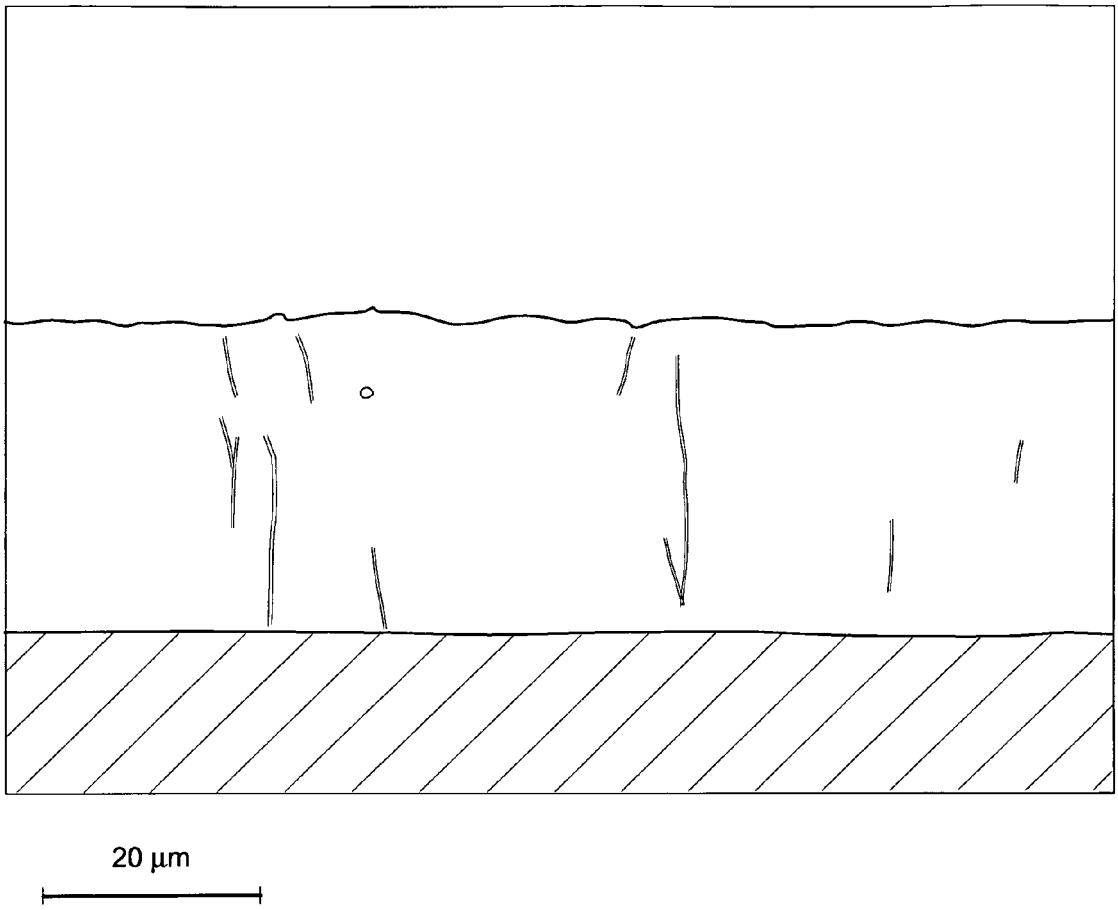
FIG. 5B is a schematic representation of a cross-sectional view, magnification 1000× of the Cr—C—P coating shown in FIG. 5A.
Figure 6:
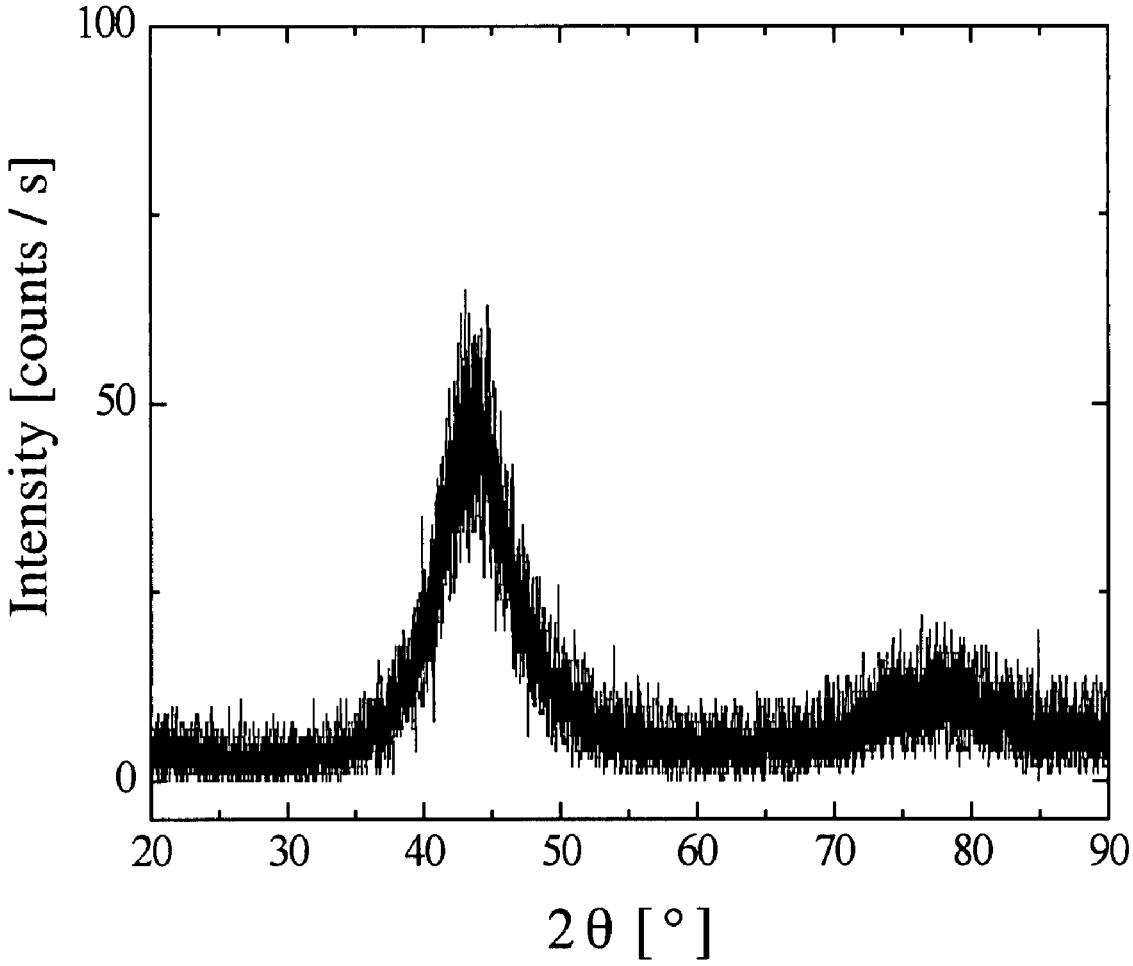
FIG. 6 shows a typical XRD pattern of an as-deposited Cr—C—P coating (2.8 wt. % P).

The morphology of the Cr—C—P coatings seems to be invariant with respect to phosphorus content. FIGS. 5A and 5B show a typical nodular morphology, similar to those from Cr—C coatings described in detail by Gines, M. J. L., Williams, F. J., and Schuh, C. A., in "Nanostructure and properties of Cr—C coatings," AESF SUR/FIN 2007, Milwaukee, Wis., USA, 121-132 (2006). XRD shows that all the coatings were amorphous in the as-deposited state (FIG. 6). The morphology and structure of these coatings are clearly different from those obtained by electroless processes; as-deposited electroless Cr—P alloys are crystalline, the extent of which varies with bath composition.

Microhardness of the as-deposited coatings obtained from bath B was measured on the cross-section of the deposits, and ranged from 550 to 650 kgf/mm$^2$ (Table 3).

TABLE 3

Effect of phosphorus content on the hardness of Cr—P and Cr—C—P coatings.

| Bath | Phosphorus content [wt. %] | Microhardness[a] [kgf/mm$^2$] | Nanohardness[b] [kgf/mm$^2$] |
|---|---|---|---|
| A | 14.5 ± 0.3 | | 802 ± 171 |
| | 20.3 ± 0.3 | | 826 ± 172 |
| B | 0 | 601 ± 26 | 841 ± 49 |
| | 0.7 ± 0.1 | 631 ± 32 | |
| | 2.7 ± 0.1 | 646 ± 35 | |
| | 2.8 ± 0.3 | 624 ± 26 | |
| | 10.2 ± 1.0 | 614 ± 27 | |
| | 13.9 ± 1.3 | 553 ± 18 | |

[a]Vicker indentor, 10 g load, average of 10 values;
[b]Berkovich indentor, XX load, average of 10 values.

A subtle relationship between the hardness and the phosphorus content emerged for this set of samples, although these values lie within the error bars for several Cr—C coatings prepared in the same way. Small amounts of P (less than ~3 wt. %) lead to a small rise in hardness, but further increases in phosphorus content produce a softening of the coating. Similarly, Palumbo et al. have found that when the hardness of Ni—P electrodeposits is analyzed as a function of phosphorus content, it initially increases up to about 2 wt. % and then rapidly decreases with higher P content. The observed behavior of crystalline material was explained in terms of both a solid solution hardening mechanism and a regular Hall-Petch strengthening mechanism. Other findings indicate that on as-deposited electroless Ni—P coatings, hardness is normally about 700 kgf/mm$^2$, and decreases with increasing phosphorus content. Because of the low thickness of the coatings obtained from bath A, additional nanohardness measurements were performed. Nanohardness measurements (~800 kgf/mm$^2$) resulted in significantly higher hardness readings than microhardness measurements. While this behavior has not yet been explained, it has been observed for other types of materials, and is known as the indentation size effect. It is worth noting that even though Cr—P and Cr—C—P coatings have been synthesized by electroless deposition and electrodeposition, no hardness value have been reported for these alloys.

The XRD data in FIGS. 7, 8, 9 and 10, demonstrate that the addition of P to Cr—C coatings generally shifts the crystallization and transformation sequence to higher temperatures. This effect is also mirrored in the evolution of the coating hardness, as illustrated in FIG. 11. The structural evolution upon annealing of Cr—C (0 wt. % P) lead to very high hardness values (up to ~1400 kgf/mm$^2$), which the present inventors have previously attributed primarily to the precipitation of interstitial-strengthened BCC Cr phase. The decline in strength at higher temperatures is related to structural coarsening, leading to a maximum in hardness after annealing near about 600° C. in the binary coating. As phosphorous is added to the deposits, the same trends are observed, but with a shift towards increasing temperatures that is commensurate with the shift in the structural evolution sequence of FIGS. 7, 8, 9 and 10. The role of phosphorous is apparently to directly stabilize the near-amorphous phase against crystallization, and a contribution to grain boundary pinning at higher temperatures cannot be ruled out. In any event, the incorporation of a properly-selected amount of phosphorous can shift the maximum hardness peak to temperatures approaching 850° C., substantially higher than the ~600° C. peak observed in the binary Cr—C system. Additionally, the hardness level attained at these temperatures (approaching 1400 kgf/mm$^2$) is substantially above that reported for other metal-metalloid deposits such as electroless and electroplated Ni—P coatings, which generally exhibit maximum hardness values of at most around 900 kgf/mm$^2$ GPa at substantially lower annealing temperatures (T<500° C.). Thus a ternary Cr—C—P coatings may find use in applications where high hardness must be maintained at elevated services temperatures, such as for tooling surfaces in warm or hot metal forming operations.

Figure 7:
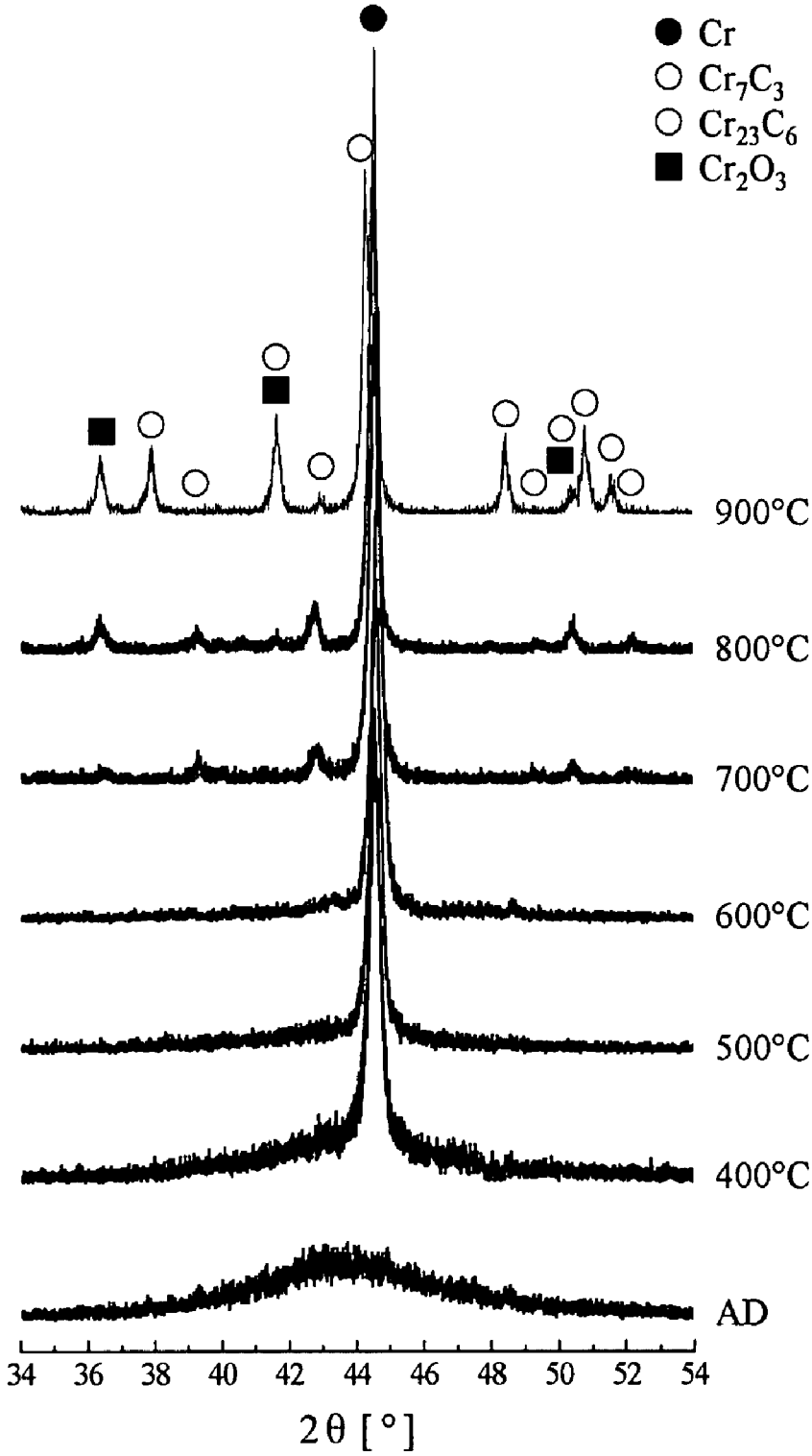
FIG. 7 is a series of XRD diffraction patterns of the Cr—C—P coatings as a function of annealing temperature, with phosphorus content of 0 wt. %.

To further address the effect of phosphorus content on the sequence of crystallization in the Cr—C—P coatings, each sample was annealed at different temperatures for 30 min in an argon flow. The structural evolution of the Cr—C—P coatings was examined as a function of temperature by XRD. FIG. 7 shows the XRD diffraction patterns of the sample without phosphorus as a function of annealing temperature. The inventors' previous research has shown that in Cr—C coatings, BCC chromium starts to form nanocrystals at around 350° C. (10 nm), and that the crystal size increases with annealing temperature. Upon annealing at 500° C., the crystal size reaches ~25 nm and there is no longer clear evidence for a co-existing amorphous phase. At temperatures above 600° C., the chromium crystal size is close to 30 nm and chromium carbide ($Cr_7C_3$) begins to precipitate. At 800° C. peaks ascribed to $Cr_2O_3$ were detected, while the chromium crystal size increased to above 45 nm. Although $Cr_{23}C_6$ was reported upon annealing of a similar coating in the literature, no peak attributable to this carbide could be detected before 900° C. Finally, at 900° C., $Cr_{23}C_6$ appears clearly whereas $Cr_7C_3$ almost disappears, suggesting that it is converted to $Cr_{23}C_6$ according to:

$$23Cr_7C_3 \rightarrow 7Cr_{23}C_6 + 27C$$

$$6C + 23Cr \rightarrow Cr_{23}C_6.$$

When a small amount of phosphorus (0.7 wt. %) is added to Cr—C coatings, not many changes are observed (FIG. 8), but chromium started to crystallize at higher temperatures from (335° C. to about 370° C.). Also, several small peaks attributable to chromium phosphides (CrP and mainly $Cr_3P$) began to appears at 700° C. For medium content of phosphorus (2.8 wt. %), the phase transition is more marked (FIG. 9). Thus, it is believed that phosphorus delays the chromium crystallization, which in this case is observed at 500° C. Also, the prevalence of chromium carbides diminished. On the other hand, chromium phosphides are easily detected at 700° C. Higher phosphorus contents (10.2 wt. %) inhibited chromium crystallization even at temperatures as high as 900° C. At this composition, the Cr—C—P coating is amorphous until 600° C., when a small peak assigned to CrP is observed. Above 700° C., $Cr_3P$ started to precipitate, which became the main phase detected at 900° C. Only small peaks corresponding to $Cr_{23}C_6$ showed up.

From these results it follows that the structure of Cr—C—P coatings is characterized by the retardation of chromium crystallization as phosphorus content increases. Due to heat treatment, new phases appeared including chromium carbides and chromium phosphides. The relative amounts of these precipitates depended on phosphorus content, such that phosphides appeared at lower temperatures and the amount of carbides diminished as phosphorus increased.

With the above improved understanding of alloy structure evolution, it is instructive to revisit the effect of annealing temperature on hardness shown in FIG. 11. For the Cr—C coating (0 wt. % P), the hardness is seen to increase when the coatings are annealed at temperatures even as low as 400° C. At around 600° C., the hardness evolves to a maximum value and then decreases for higher annealing temperatures. For this coating, it was found that at temperatures around 300° C. the hardness increases, despite the fact that no compound phases were formed. This behavior may be attributed to the formation of dispersed Cr nanocrystals in the amorphous matrix leading to strengthening, which is also observed on partially devitrified metallic glasses containing metalloids. At progressively higher annealing temperatures, at least up to 600° C., hardness continues to increase, despite the fact that the Cr grain size is also increasing; the classical Hall-Petch relationship indicates that grain growth should promote softening. Nevertheless, in the present coatings the growth of the Cr crystals is convoluted with an increasing volume fraction of the crystal phase within an amorphous matrix. The hardening is most likely a consequence of the crystalline volume fraction increase. At around 600° C., the hardness evolves to a maximum value, and then softens for higher annealing temperatures. The emergence of carbide and oxide phases at 700° C. (FIG. 7) does not correlate with increased hardness; it is possible that softening due to the increase in Cr grain size at this temperature prevails over the hardening effects of those phases.

Despite the fact that in phosphorus-free Cr—C coatings the maximum in hardness is observed between approximately 500° C. and 700° C., these temperatures might be not high enough for some industrial applications. Phosphorus, as included in Cr—C—P electrodeposits, appears to be a good element to enhance the hardness, moving the typical temperature-hardness curve towards temperatures higher than 600° C. The annealing temperature at which these maximum hardness values are reached depends strongly on the phosphorus content. The significant high hardness values at high annealing temperatures might be a direct result of the stable quasi-amorphous chromium matrix, and possibly also to effective grain boundary pinning by the phosphorus solute and chromium phosphide precipitates (CrP and mainly $Cr_3P$), which form during annealing.

Figure 8:
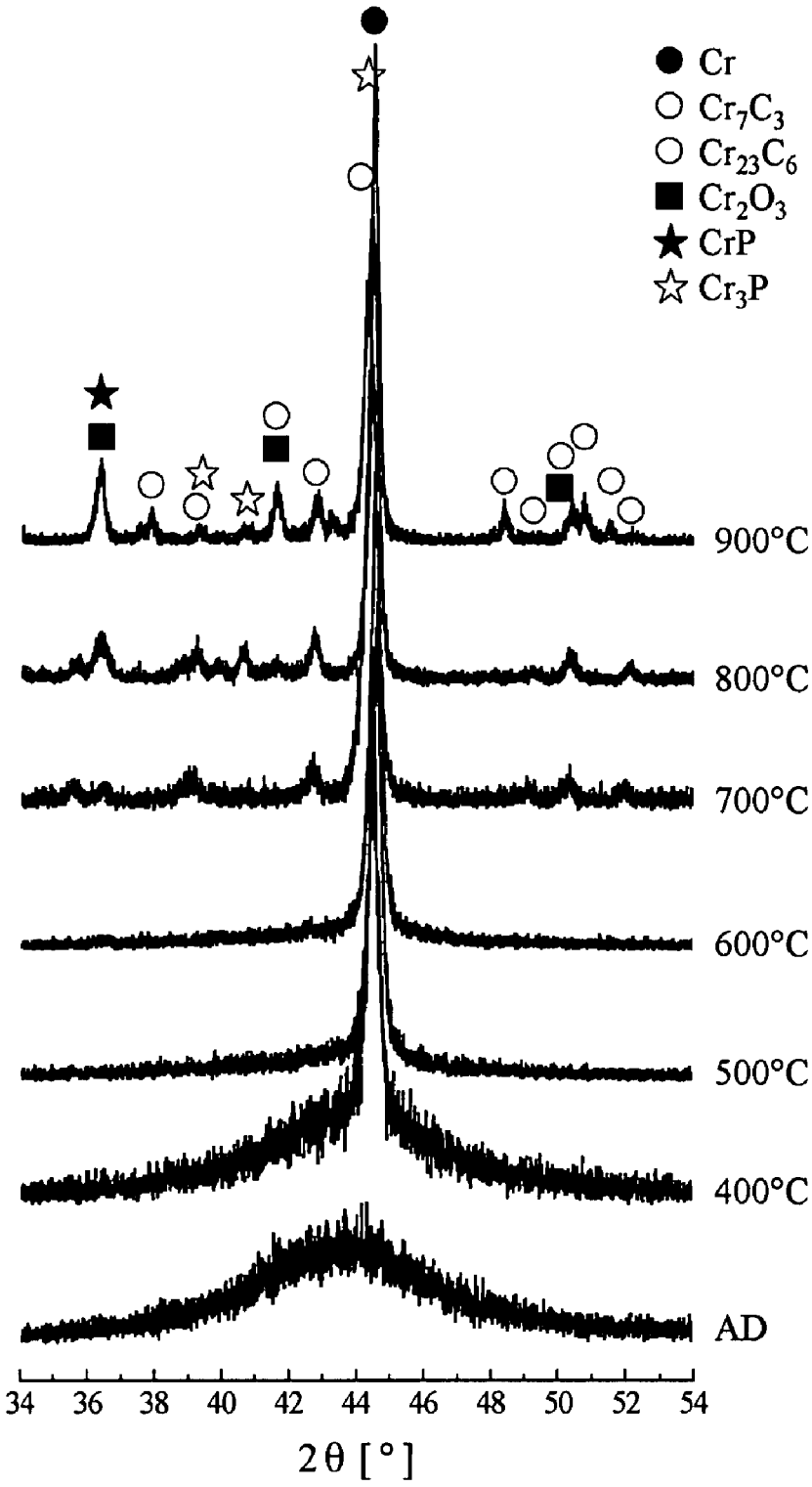
FIG. 8 is a series of XRD diffraction patterns of the Cr—C—P coatings as a function of annealing temperature, with phosphorus content of 0.7 wt. %.
Figure 9:
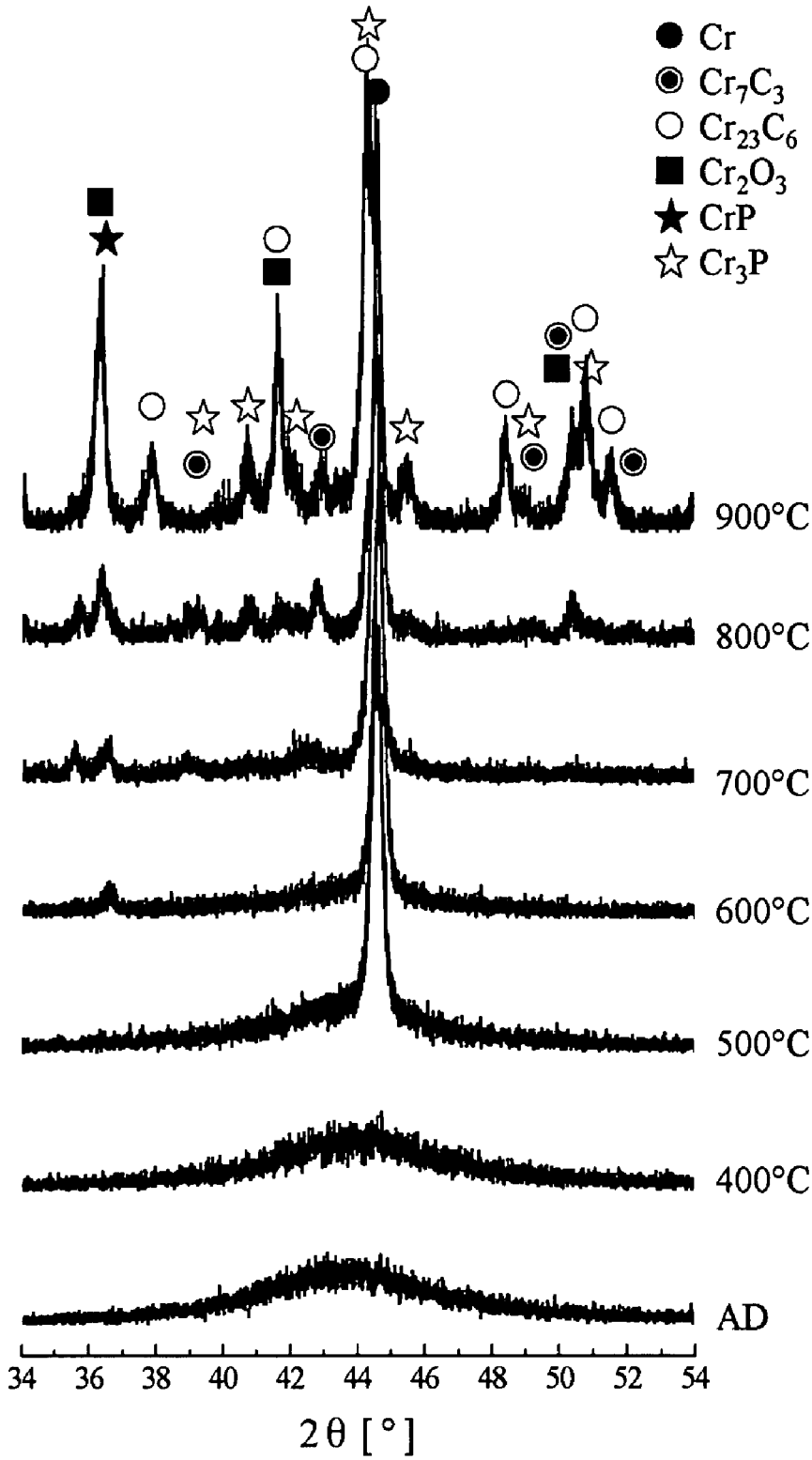
FIG. 9 is a series of XRD diffraction patterns of the Cr—C—P coatings as a function of annealing temperature, with phosphorus content of 2.8 wt. %.
Figure 10:
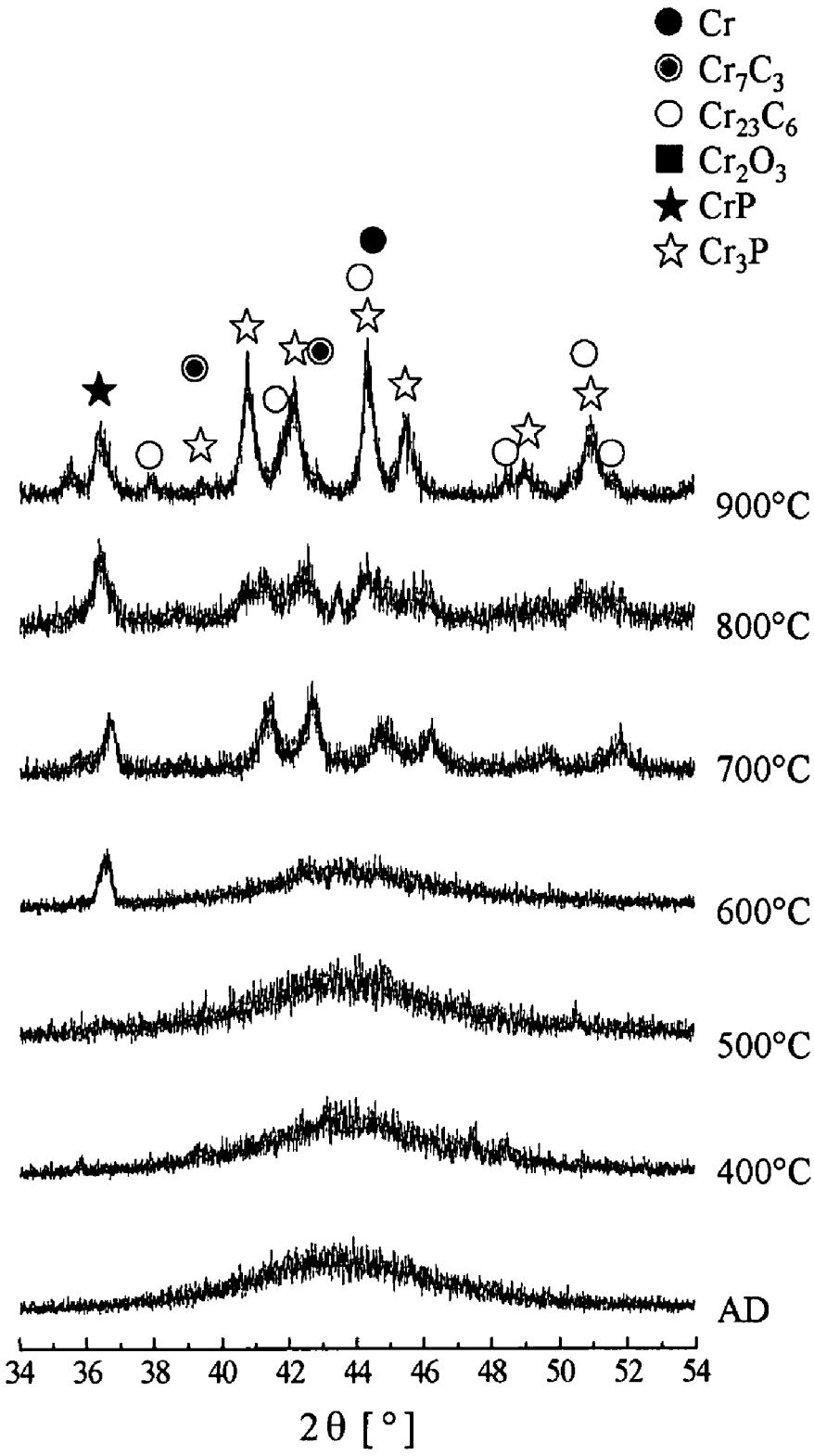
FIG. 10 is a series of XRD diffraction patterns of the Cr—C—P coatings as a function of annealing temperature, with phosphorus content of 10.2 wt. %.
Figure 11:
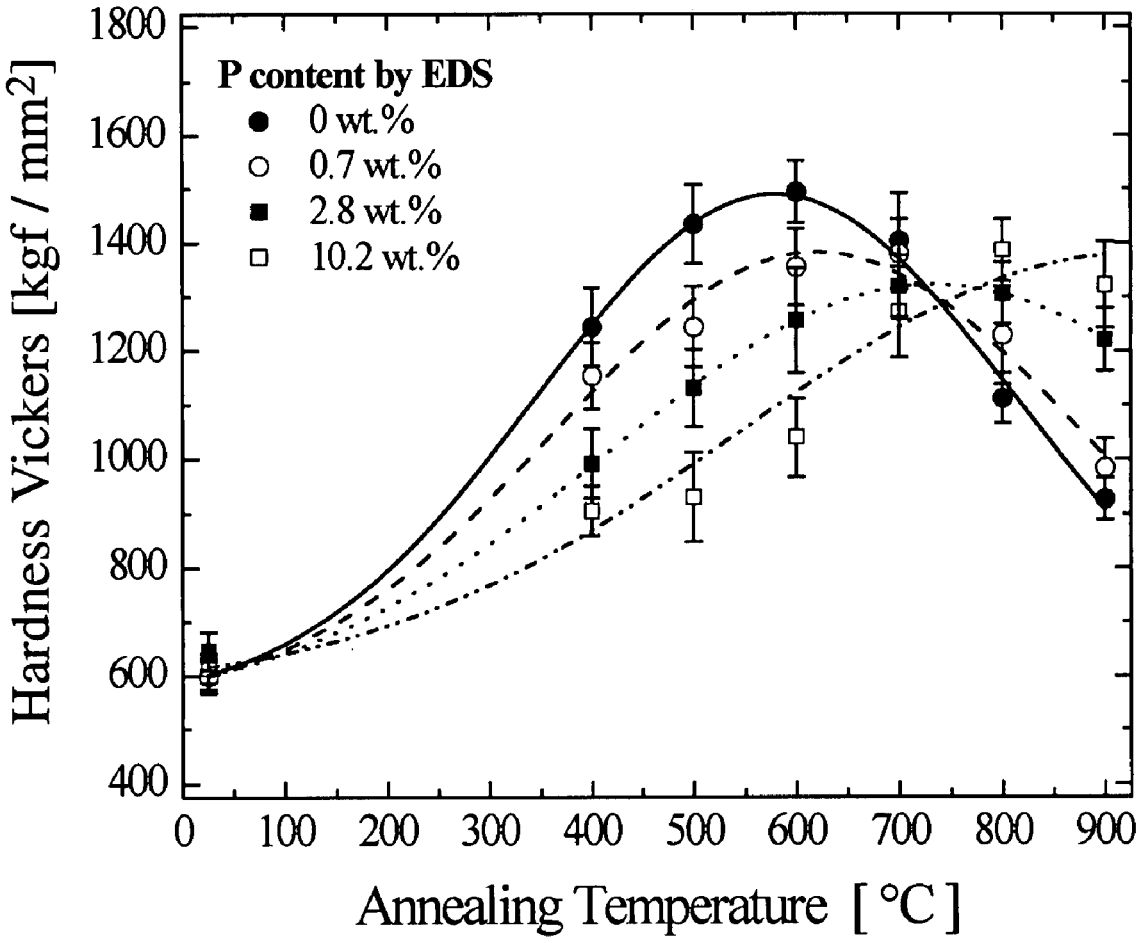
FIG. 11 shows, graphically, the effect of annealing temperature and phosphorus content on hardness of electrodeposited Cr—C—P coatings, where each specimen was annealed for 30 minutes in an argon atmosphere, and a load of 10 g was applied, then ten measurements were made for each load (10 g) and the average is reported.

FIGS. 8, 9 and 10 show significant amounts of the compounds CrP and $Cr_3P$ in the coatings, as well as others that do not contain phosphorous. Body centered cubic (BCC) chromium is also present. The phase domains typically have a characteristic size smaller than 500 nanometers. The small size of the domains can be assessed by many means. In these experiments the x-ray diffraction data were analyzed to assess the peak broadening, and this translated into an mean domain size using standard techniques. Transmission electron microscopy was also conducted to directly observe the small (<500 nm) size of the phase domains and grains in the structure. In general, the process can produce articles with coatings having a hardness of greater than 500 kgf/mm$^2$ after experiencing temperatures above 100° C., and even at temperatures which are advantageous over the prior art above 600° C. In fact, it can produce coatings having a hardness of greater than 1,000 kgf/mm$^2$ after experiencing temperature above 650° C.

FIG. 11 shows a hardness vs. annealing temperature curve for chromium coatings having various phosphorous content. It shows that any amount of phosphorous tends to move the curve to the right, so that the maximum hardness arises from annealing at a higher temperature than the 600° C. for a phosphorous free coating, which in turn means that the coating could be used at higher temperatures in service. Further, any amount of phosphorous provides a higher hardness than no phosphorous, after annealing at temperatures above the temperature at which annealing the phosphorous-free coating and the phosphorous-containing coating result in the same hardness. Each concentration of phosphorous has such a cross-over temperature.

Although no data was taken to demonstrate a maximum temperature at which a coating can be used, relative to the temperature at which it was annealed, typically the maximum use temperature increases with the annealing temperature.

In general, based on the experimental work reported herein, and experience, the inventors estimate that coatings described herein could be used at temperatures up to about 50° C. below the temperatures at which they were annealed, and still retain adequate hardness, and certainly a hardness greater than that of an otherwise identical phosphorous free coating.

The elevated temperatures that give rise to the phase transformations, such as through annealing, need not be provided by a relatively passive heat treatment. They can be provided through use, at working temperatures sufficiently high to cause the structural changes. Structural evolutions can also occur under other conditions of use, for example during mechanical loading or reciprocating mechanical loading either in service or as a separate treatment step. Shot peening is an example of repeated mechanical loading, and reciprocating sliding contact is an example of reciprocating mechanical loading.

Most of the foregoing discussion contemplates that the plating operation will be an electrolytic bath or fluid plating operation. Other plating methods are also possible, such as a vapor deposition, for instance by sputtering. In such methods, known techniques can control the composition of the deposited coating. For example, different targets would need to be provided to insure deposition of Cr and P simultaneously. A person skilled in the art of such deposition would be able to produce such coatings. Inventions disclosed herein then allow a high-temperature exposure to render the coating with improved properties such as hardness.

Some conclusions regarding the preparation and thermal treatment of Cr—P and Cr—C—P alloys can be generalized. Using sodium hypophosphite as a complex for $Cr^{3+}$ produces coatings with a high content of phosphorus, leading to extremely low efficiencies. Adding sodium hypophosphite to an organic-based trivalent bath produces Cr—C—P with a broader range of phosphorus content and higher efficiencies. All the deposits had the same structure regardless of the amount of phosphorus incorporated into the coating, appearing amorphous in x-ray diffraction experiments. Structural changes during annealing lead to very high hardness values, which depend on the phosphorus content. For phosphorus-free chromium coatings, the hardness shows a maximum value (~1400 kgf/mm$^2$) at 600° C. As phosphorus content increases, the coatings perform better at higher temperatures, reaching a value of hardness close to 1350 kgf/mm$^2$ at 800° C., while phosphorus-free chromium coatings show a value below 1100 kgf/mm$^2$. This behavior is attributable to the precipitation of carbides and phosphides in the chromium amorphous matrix. Adding phosphorus retards the crystallization of chromium. At phosphorus contents higher than 10 wt. %, chromium crystallization is inhibited for annealing temperatures even as high as 900° C.

Many techniques and aspects of the inventions have been described herein. The person skilled in the art will understand that many of these techniques can be used with other disclosed techniques, even if they have not been specifically described in use together. For instance, various formulations of Cr and C and P can be used, and can be annealed or worked at different temperatures. The applied coatings can be applied by electrolytic plating, or by vapor deposition, such as by sputtering. The coating can be on any sort of substrate in terms of materials (metals, alloys, ceramics, organics, etc.). The coating can have a wide range of thicknesses, from sub-micron to millimeters or more.

This disclosure describes and discloses more than one invention. The inventions are set forth in the claims of this and related documents, not only as filed, but also as developed during prosecution of any patent application based on this disclosure. The inventors intend to claim all of the various inventions to the limits permitted by the prior art, as it is subsequently determined to be. No feature described herein is essential to each invention disclosed herein. Thus, the inventors intend that no features described herein, but not claimed in any particular claim of any patent based on this disclosure, should be incorporated into any such claim.

Some assemblies of hardware, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

What is claimed is:

1. A coated article comprising:

a. a substrate; and b. a coating on the substrate, comprising: chromium, carbon and phosphorous, the chromium and the phosphorous being present in at least one of the compounds selected from the group consisting of:

i. CrP; and ii. $Cr_3P$.

2. The article of claim 1, chromium of the coating comprising the body-centered cubic chromium phase.

3. The article of claim 1, the coating comprising individual phase domains having a mean characteristic size of smaller than approximately 500 nanometers.

4. The article of claim 1, the coating having a hardness greater than 900 kgf/mm$^2$.

5. The article of claim 1, the coating having a hardness of greater than 500 kgf/mm$^2$ at a temperature greater than 100° C.

6. The article of claim 1, the coating having a hardness of greater than 500 kgf/mm$^2$ at a temperature greater than 600° C.

7. The article of claim 1, the coating having a hardness of greater than 1000 kgf/mm$^2$ at a temperature greater than 650° C.

8. The article of claim 1, the coating having a hardness of greater than 1000 kgf/mm$^2$ at a temperature greater than 800° C.

9. The article of claim 1, the coating comprising an electrolytically deposited coating.

10. The article of claim 1, the coating comprising a vapor deposition coating.

* * * * *